US009693438B2

(12) United States Patent
Kutra et al.

(10) Patent No.: US 9,693,438 B2
(45) Date of Patent: Jun. 27, 2017

(54) X-RAY APPARATUS

(71) Applicant: KONINKLIJKE PHILIPS N.V., Eindhoven (NL)

(72) Inventors: Dominik Benjamin Kutra, Hamburg (DE); Thomas Buelow, Grosshansdorf (DE); Gerhard Martens, Henstedt-Ulzburg (DE); Hanns-Ingo Maack, Norderstedt (DE); Kirsten Regina Meetz, Hamburg (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/428,016

(22) PCT Filed: Aug. 6, 2014

(86) PCT No.: PCT/IB2014/063727
§ 371 (c)(1),
(2) Date: Mar. 13, 2015

(87) PCT Pub. No.: WO2015/022600
PCT Pub. Date: Feb. 19, 2015

(65) Prior Publication Data

US 2016/0157329 A1 Jun. 2, 2016

(30) Foreign Application Priority Data

Aug. 15, 2013 (EP) ..... 13180568

(51) Int. Cl.
*H01J 35/14* (2006.01)
*H05G 1/30* (2006.01)
*G21K 1/02* (2006.01)

(52) U.S. Cl.
CPC ..... *H05G 1/30* (2013.01); *G21K 1/025* (2013.01)

(58) Field of Classification Search
CPC ..... H05G 1/30; G21K 1/025
USPC ..... 378/37, 145–153, 138
See application file for complete search history.

(56) References Cited

U.S. PATENT DOCUMENTS

| | | | | |
|---|---|---|---|---|
| 4,773,087 | A | 9/1988 | Plewes | |
| 7,940,890 | B1 * | 5/2011 | Linev | A61B 6/06 378/146 |
| 2002/0122533 | A1 * | 9/2002 | Marie | A61B 6/502 378/196 |
| 2006/0034426 | A1 | 2/2006 | Freudenberger et al. | |
| 2011/0075792 | A1 | 3/2011 | Akahori | |

FOREIGN PATENT DOCUMENTS

| | | | |
|---|---|---|---|
| EP | 1192479 | B1 | 4/2002 |
| EP | 1623672 | A1 | 2/2006 |
| JP | 59080232 | A | 5/1984 |
| JP | 1176406 | A | 7/1989 |

(Continued)

*Primary Examiner* — Courtney Thomas

(57) ABSTRACT

X-ray apparatus, with a collimator arrangement (12*a*, 18, 28*a*) positioned between the focus point (12*b*) and the detector (28*b*), mechanics (43) for enabling motion of the collimator arrangement, the detector and the x-ray source along a scan trajectory (30) in a x-z plane (83) and also along curved scan trajectory (45), which partly extents along a y-axis (35) perpendicular to the x-z plane. By using this invention better tissue coverage of objects with curved edges can be obtained.

12 Claims, 3 Drawing Sheets

(56) References Cited

FOREIGN PATENT DOCUMENTS

| | | | |
|---|---|---|---|
| JP | 6205332 | A | 7/1994 |
| JP | 6205334 | A | 7/1994 |
| JP | 6205335 | A | 7/1994 |
| JP | 10295680 | A | 11/1998 |
| JP | 2005021328 | A | 1/2005 |
| WO | 0055645 | A1 | 9/2000 |

* cited by examiner

X-RAY APPARATUS

CROSS-REFERENCE TO PRIOR APPLICATIONS

This application is the U.S. National Phase application under 35 U.S.C. §371 of International Application Serial No. PCT/IB2014/063727, filed on Aug. 6, 2014, which claims the benefit of European Application Serial No. 13180568.1, filed on Aug. 15, 2013. These applications are hereby incorporated by reference herein.

FIELD OF THE INVENTION

The invention relates to a system in the field of X-ray imaging and more specifically to the mechanics for enabling motion of the collimator arrangement, the detector and the x-ray source.

BACKGROUND OF THE INVENTION

Conventional systems for X-ray imaging comprise an X-ray source and an area detector placed behind an object to register an image. The main drawback with this setup is its sensitivity to background noise in form of Compton scattered radiation.

As a solution to this, a slot scanning system has been proposed. Such a system is for example known from EP1192479 B1. A slot scanning system described in EP1192479 B1 comprises an X-ray source and a collimator arrangement comprising several collimator structures. Furthermore, the slot scanning system comprises a detector array and compression plates in between for example a breast can be positioned and compressed. The compression plates are transparent to X-rays. One of the collimator structures is positioned on one side of the compression plates, whereas another collimator structure is positioned at the other side of the compression plates. The slots of the collimator structures are matched and in line with the X-ray source so that the X-rays coming straight from the source, without deflections, that will pass one collimator structure, will also pass the other collimator structure and will hit the detector which is positioned in line with the collimator structures and the X-ray source. The collimator structures are positioned on an arm together with the detector. This arm can move the slots relative to the object.

The stage of the movement is computer controlled and equipped with an accurate position reading. While the slots are moving, data from the detector arrays are read out together with the present coordinate according to the position reading. From this information the image is reconstructed.

The scan trajectory described in EP 1192479 B1 can be a circular movement around the X-ray source. The trajectory can also be arranged to refract the beam in a plane parallel with the compression plates, whereby a linear movement of the collimator and detector will be needed. Moreover, due to the circular radiation, the detectors are arranged in a circular carrier, which in case of a linear movement should be arranged in a flat carrier.

SUMMARY OF THE INVENTION

It is an object of the invention to obtain better coverage of an object to be scanned, when scanning with an X-ray apparatus comprising a detector and a collimator arrangement which are configured to move along a scan trajectory in order to enable medical X-ray imaging.

This object is achieved by an X-ray apparatus, comprising

- An X-ray source (20) configured for producing an X-ray beam (16) and comprising a focus position (12*b*);
- A detector (28*b*) configured for detecting X-radiation;
- A collimator arrangement (12*a*, 18, 28*a*) comprising at least one collimator structure, positioned between the focus point (12*b*) and the detector (28*b*);
- Mechanics (43) for enabling motion of the collimator arrangement, the detector and the x-ray source along a scan trajectory (30) in an x-z plane (83)
- A control unit configured for controlling the mechanics for enabling motion of the collimator arrangement (12*a*, 18, 28*a*), the detector (28*b*) and the x-ray source (20, 12*b*) along the scan trajectory (30)

Characterized in that

- The mechanics (43) for enabling the scan trajectory (30) of the collimator arrangement (12*a*, 18, 28*a*), the detector (28*b*) and the x-ray source (20, 12*b*) is also configured for enabling motion along a curved scan trajectory (45), which partly extents along a y-axis (35) perpendicular to the x-z plane.

It is an insight of the invention that when scanning an object with a curved edge (like a breast) with the conventional slot scanning system (or other X-ray apparatus comprising a detector and a collimator arrangement which are configured to move along a scan trajectory in order to enable medical X-ray imaging), part of the object may not be scanned. For example, during a conventional mammography acquisition, the breast is positioned on a rectangular table or detector housing with a rectangular detector. Also the scan trajectory is limited to one plane (here further called x-z plane). However, the thorax has a curved cross section. Limitation of the scan trajectory to the x-z plane limits the amount of breast tissue that can be imaged. As a result, medial and/or lateral parts of the breast are challenging to image. By allowing a curved scan trajectory, which extents along an axis (here further called y-axis) perpendicular to the x-z plane, better coverage of breast tissue and other objects with curved edges can be obtained when using a slot scanning system. In turn, better coverage of objects may lead to a higher sensitivity in detecting cancer or other pathologies. To fully benefit from the curved scan trajectory that also extents along the y-axis, also the scanner housing in the vicinity of the detector needs to match the curvature in a x-y plane, perpendicular to the x-z plane. In case the slot scanning system is used as a mammography system, also the curvature of compression plates of the system needs to be adjusted.

According to one aspect of the invention the curved trajectory can be obtained by mechanics for enabling motion of the X-ray source, the collimator arrangement and the detector, wherein the mechanics comprise a base element, a guiding element and a moving element. The guiding element is connected to the base element and configured for guiding the moving element along the curved scan trajectory relative to the base element and the guiding element. The detector and/or the collimator arrangement and/or the x-ray source are connected to the moving element. The mechanics for enabling motion of the X-ray source, the collimator arrangement and the detector could be separately connected to the each of the said items. In this case separate mechanical structures are required to move the X-ray source, the detector and the collimator arrangement along the curved scan trajectory. Also the mechanics for enabling motion of the collimator arrangement and the detector could be connected to an arm to which in turn the detector and collimator arrangement can be connected. This is advantageous when used for slot scanning, because in this way the detector and collimator arrangement remain aligned during movement.

In a breast cancer screening environment two images of the breast are acquired: one from head to toe (cranio caudal (CC) view) and one from the side (medio lateral oblique (MLO) view). The thorax has a different curvature in both directions. Therefore it may be beneficial to enable adjustment of the curvature of the curved scan trajectory to better image the breast in both directions.

These and other aspects of the invention will be apparent from and elucidated with reference to the embodiments described hereinafter.

DETAILED DESCRIPTION OF THE INVENTION

Figure 1:
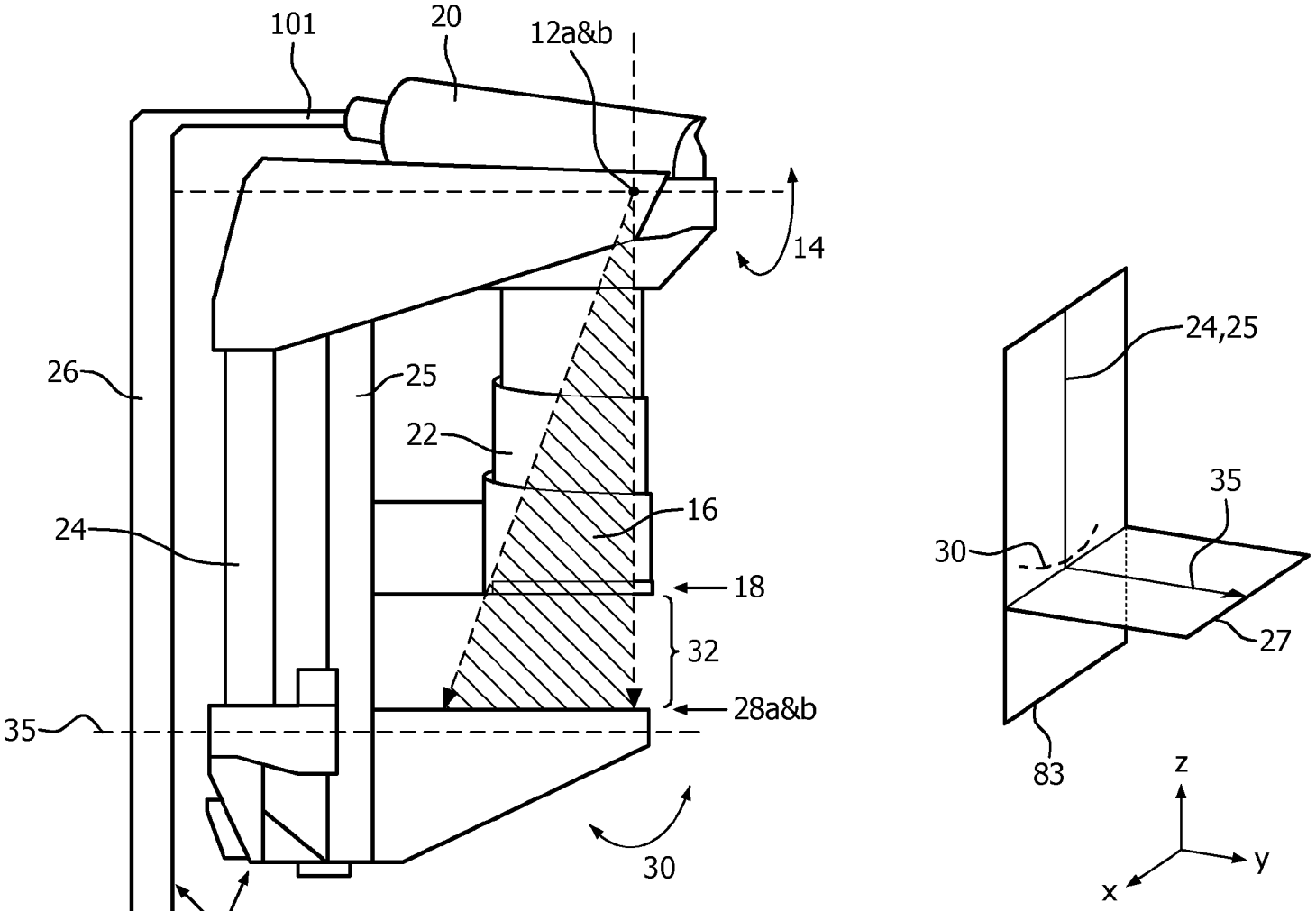
FIG. 1 diagrammatically shows part of a slot scanning system.

FIG. 1 diagrammatically shows part of a slot scanning system. The slot scanning system comprises an X-ray source (20), which comprises a focus position (12*b*) and a first rough collimator structure (12*a*). From the X-ray focus position a conical X-ray beam (16) emerges, which passes onto the collimators and the detector. The slot scanning system further comprises an X-ray shield (22) to shield scattered X-rays for example coming from the collimators 12*a* and 18 and other components of the surroundings of the system. The slot scanning system comprises a collimator structure (18) above and below (28*a*) the examination area (32). The combined collimator structures in the slot scanning system are here called the collimator arrangement (12*a*, 18, 28*a*). X-rays will travel from the X-ray focus position (12*b*) via the collimator arrangement (12*a*, 18, 28*a*) to a detector (28*b*). The X-ray source, collimator arrangement and detector are connected to arms (24, 25), which can move relative to a holder (26) within a plane (83, x-z plane). The movement of the detector and collimator arrangement is computer controlled by means of a control unit (101) and equipped with position reading. In a further configuration the arm (25) keeping the detector and the collimator arrangement, is configured to make a circular scan trajectory (14, 30), within the x-z plane (83), partly around the X-ray focus position (12*b*). The invention proposes to extent the scan trajectory partly along an axis (35, y-axis) perpendicular to the x-z plane (83). This can for example be obtained by making arms (24) and (25) movable relative to each other. One arm (24 or 25) could be configured to enable motion inside the x-z plane, whereas the other arm (25 or 24) could be configured to extent the scan trajectory along the y-axis (35). However, independent motion of arms (24) and (25) is not necessary. For example, also a single arm could be used and configured to enable motion along the curved scan trajectory (45), that partly extents along the y-axis (35).

To fully benefit from the invention also the scanner housing close to the detector (28*b*) and the collimator structures (28*a*) need to have a similar curvature in the x-y plane (27), as the curved scan trajectory. When used in mammography also compression plates need to have a similar curvature in the x-y plane as the curved scan trajectory.

In the configuration shown in FIG. 1, this would imply that the extension of the scan trajectory along the y-axis would be larger close to the detector (28*b*), than close to the X-ray source (20). The curvature of the scan trajectory can be adjusted by extending the movement of the detector and collimator arrangement more or less along the y-axis.

The curved scan trajectory is enabled by mechanics enabling motion of the collimator arrangement (12*a*, 18, 28*a*) and the detector (28*b*), which are preferably located at one of locations (33).

Figure 2A:
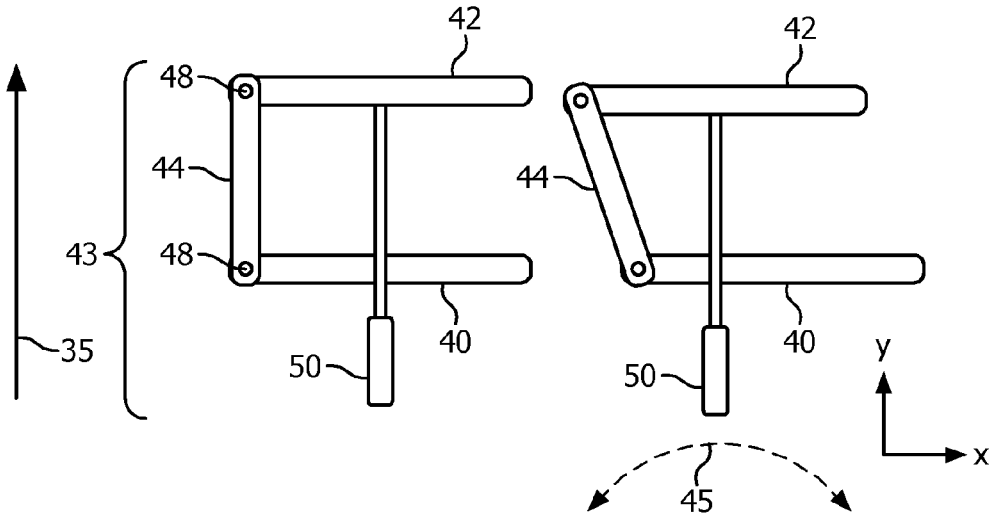
FIG. 2 diagrammatically shows an embodiment of the mechanics enabling motion of the collimator arrangement, the detector and the x-ray source.
Figure 2B:
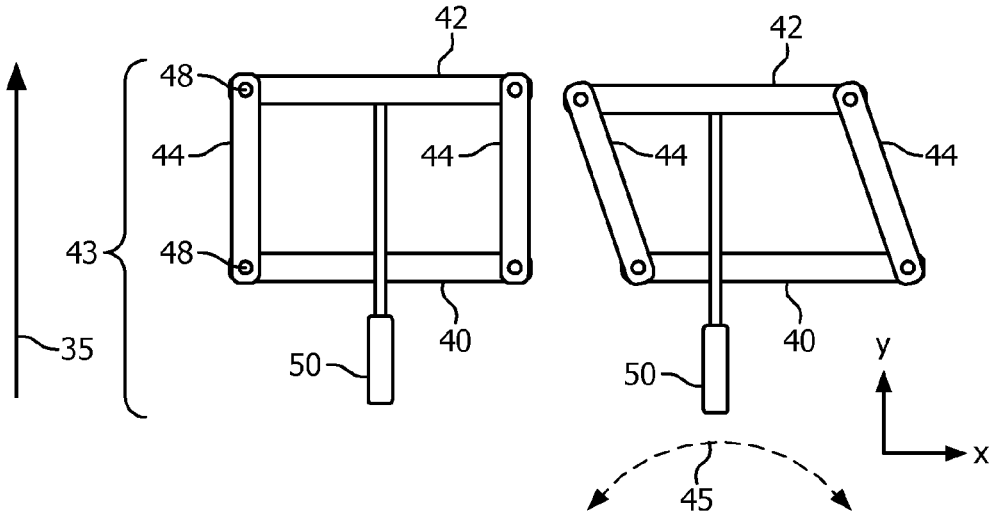
Figure 3:
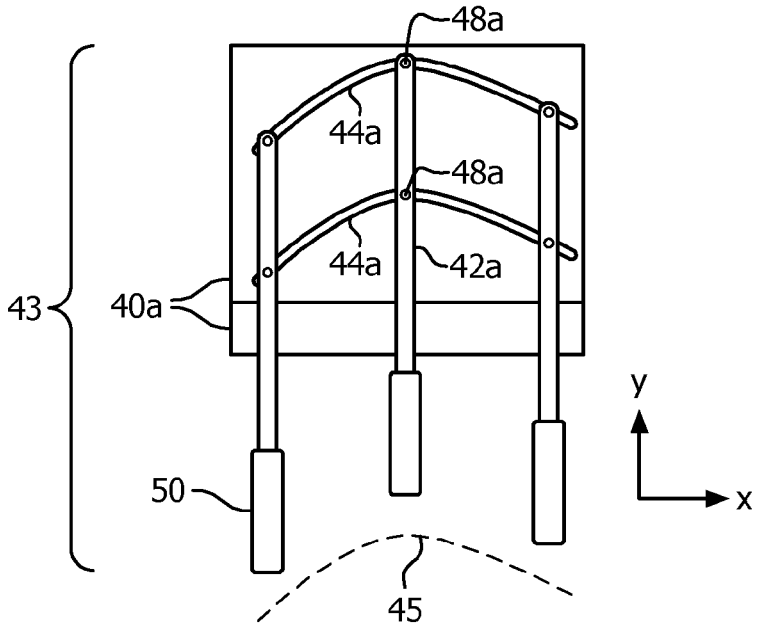
FIG. 3 diagrammatically shows another embodiment of the mechanics enabling motion of the collimator arrangement, the detector and the x-ray source.

FIG. 2 diagrammatically shows an embodiment of the mechanics enabling motion of the collimator arrangement (12*a*, 18, 28*a*), the detector (28*b*) and the x-ray source (20). FIG. 3 diagrammatically shows another embodiment of the mechanics enabling motion of the collimator arrangement (12*a*, 18, 28*a*), the detector (28*b*) and the x-ray source (20). The mechanics (43) enabling motion of the collimator arrangement (12*a*, 18, 28*a*), the detector (28*b*) and the x-ray source (20) comprises a base element (40,40*a*), which can be connected to a part of the slot scanning system, which is fixed relative to the detector and collimator arrangement, e.g. the holder (26) or arm (24). Also the base element (40,40*a*) can be connected to any location in an examination room, wherein the slot scanning system is positioned. The mechanics (43) further comprises a guiding element (44, 44*a*) configured for guiding a moving element (42, 42*a*) along a curved scan trajectory (45). In one embodiment of the invention the guiding element (44) is rotatable connected to the base element (40), whereas the moving element (42) is rotatable connected to the guiding element (44). Rotation can be performed around connection areas (48). In this way the curved scan trajectory (45) can be established. In FIG. 2A only one guiding element is depicted. Preferably another guiding element is added to the mechanics in order to create a parallelogram structure. An example of such a parallelogram structure is depicted in FIG. 2B. A parallelogram structure increases the stability and robustness of the mechanics.

According to another embodiment of the invention, the moving element (42*a*) is translatable connected to the guiding element (44*a*), which is for example a curved guide, rail. The guiding element could also be a curved cut, notch, cavity or the like in base element (40*a*) to which the moving element is translatable connected. In FIG. 3, two guiding elements are depicted. Of course, also one curved guide, rail, cut, notch, or cavity etc could be used.

The X-ray source, the detector (28*b*) and the collimator arrangement (12*a*, 18, 28*a*) are connected to the mechanics enabling motion of the collimator arrangement (12*a*, 18, 28*a*) and the detector (28*b*) preferably via an arm (24). The detector (28*b*) and the collimator arrangement (12*a*, 18, 28*a*) as well as the X-ray source could also be connected separately to a fixed part of the slot scanning system or to position in the examination room. In this case more than one mechanical structure (43) is needed for moving the detector and collimator arrangement. The arm (24, 25), or detector (28*b*) and collimator arrangement (12*a*, 18, 28*a*) can be connected to part (50) of the mechanics for enabling motion of the collimator arrangement and the detector.

Figure 4:
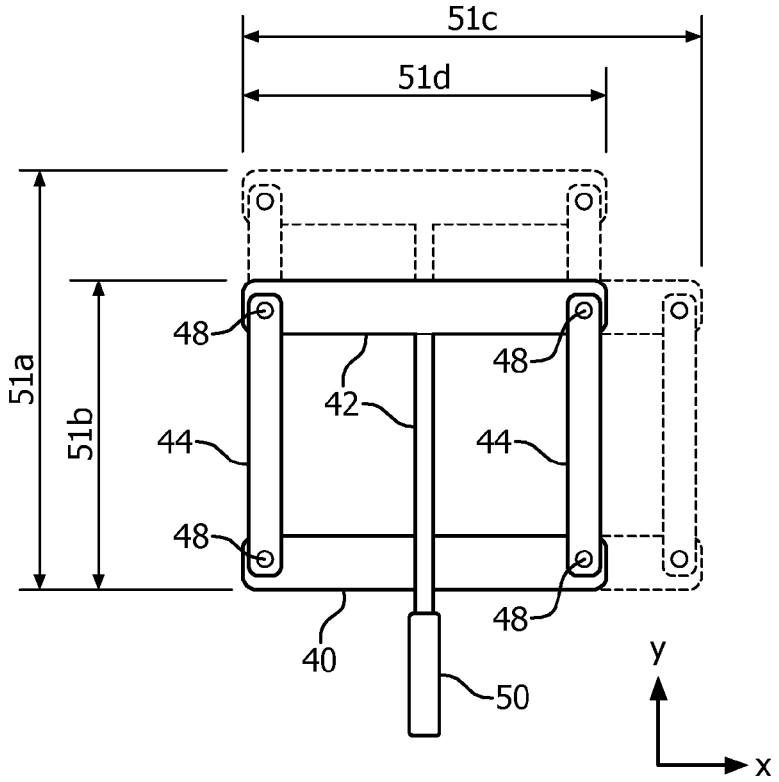
FIG. 4 diagrammatically shows an example on how the curved scan trajectory can be extended in the x and/or y direction.

According to another embodiment of the invention, the guiding element is translatable connected to the base (40) and moving element (42), in such a way that the rotation points can be shifted. In this way an effective length (51*a*, 51*b*, 51*c*, 51*d*) of the guiding and/or moving element can be adjusted. This could result in an extension of the curved scan trajectory in x and/or y direction. FIG. 4 diagrammatically shows an example on how the curved scan trajectory can be extended in the x and/or y direction. The mechanics can be adjusted prior or during scanning in order to change the curvature of the curved scan trajectory. This embodiment is also advantageous for adjusting the curve of the curved scan trajectory depending on the curvature of the object to be scanned (e.g. scan in CC or MLO view). Adjustment of the effective length (51*a*, 51*b*, 51*c*, 51*d*) could be performed as a result of a user request, but could also be performed automatically when changing from CC to MLO scan orientation or the other way around. Adjustment of the effective length could be obtained for example by sliding the moving and/or the guiding element to a second connection area on the respectively guiding and/or moving element. Also the guiding and/or moving element could comprise two concentric parts, which can shift relative to each other (a telescope like structure) whereby the moving and/or guiding element is connected to one of inner of outer parts. The adjustment could for example be controlled by a stepper motor. Adjustment of the curvature of the housing of the detector and/or compression plates is important to match the curvature in the x-y direction of the curved scan trajectory. The adjustment of the curvature of the housing of the detector and/or compression plates could be established in a manner known per se from the U.S. Pat. No. 6,741,673 B2. Different sides of the housing and/or compression plates could have different curvatures. By turning the housing and/or compression plates, the housing and/or compression their curvature can be adjusted to meet adjustments in the curvature of the curved scan trajectory.

Whilst the invention has been illustrated and described in detail in the drawings and foregoing description, such illustrations and description are to be considered illustrative or exemplary and not restrictive; the invention is not limited to the disclosed embodiments.

The invention claimed is:

1. An X-ray apparatus comprising an X-ray source configured for producing an X-ray beam and comprising a focus position;

a detector configured for detecting X-radiation;

a collimator arrangement comprising at least one collimator structure, positioned between the focus position and the detector;

mechanics that move the collimator arrangement, the detector and the X-ray source along a curved scan trajectory travelling through an x-z plane and extending along a y-axis perpendicular to the x-z plane; and a control unit configured for controlling the mechanics to move the collimator arrangement, the detector and the X-ray source along the curved scan trajectory, wherein a curvature of the curved scan trajectory is adjustable.

2. The X-ray apparatus as claimed in claim 1, wherein the mechanics comprise:

a base element;

a moving element, to which the detector and/or the collimator arrangement and/or the X-ray source is connected and which is configured to move relative to the base element; and a guiding element configured for guiding the moving element along the curved scan trajectory.

3. The X-ray apparatus as claimed in claim 2, wherein the guiding element is rotatably connected to the base element and the moving element is rotatably connected to the guiding element.

4. The X-ray apparatus as claimed in claim 2, wherein the guiding element is curved.

5. The X-ray apparatus as claimed in claim 1, wherein the curvature of the curved scan trajectory is adjustable by adjustment of an effective length of the guiding and/or moving element.

6. The X-ray apparatus of claim 2, wherein the guiding element is configured as a parallelogram.

7. The X-ray apparatus of claim 5, further comprising a stepper motor that adjustably controls the effective length.

8. The X-ray apparatus of claim 1, further comprising an arm that connects the X-ray source, the detector, and the collimator arrangement to the mechanics.

9. The X-ray apparatus of claim 1, wherein the collimator arrangement, the detector, and the X-ray source cooperate to acquire X-radiation information at multiple locations along the curved scan trajectory from which imagery of a patient is created.

10. An X-ray apparatus comprising an X-ray source configured for producing an X-ray beam and comprising a focus position;

a detector configured for detecting X-radiation;

a collimator arrangement comprising at least one collimator structure, positioned between the focus position and the detector;

mechanics comprising: a base element; a moving element, to which the detector and/or the collimator arrangement and/or the X-ray source is connected and which is configured to move relative to the base element; and a guiding element configured for guiding the moving element along a, curved scan trajectory, the mechanics adapted to move the collimator arrangement, the detector and the X-ray source along the curved scan trajectory travelling through an x-z plane and extending along a y-axis perpendicular to the x-z plane, wherein a curvature of the curved scan trajectory is adjustable; and a control unit configured for controlling the mechanics to move the collimator arrangement, the detector and the X-ray source along the curved scan trajectory, wherein the guiding element is configured as a parallelogram.

11. The X-ray apparatus of claim 10, further comprising an arm that connects the X-ray source, the detector, and the collimator arrangement to the mechanics.

12. The X-ray apparatus of claim 11, wherein the collimator arrangement, the detector, and the X-ray source cooperate to acquire X-radiation information at multiple locations along the curved scan trajectory from which imagery of a patient is created.

* * * * *